US005850964A

United States Patent [19]

Rosenbaum et al.

[11] Patent Number: 5,850,964

[45] Date of Patent: Dec. 22, 1998

[54] CARTON CONSTRUCTION

[75] Inventors: W. John Rosenbaum, Indianapolis; Mark A. Bendit, Avon, both of Ind.

[73] Assignee: ACCO Brands, Inc., Lincolnshire, Ill.

[21] Appl. No.: 998,779

[22] Filed: Dec. 29, 1997

[51] Int. Cl.[6] ..... B65Q 5/10

[52] U.S. Cl. ..... 229/117.16; 229/183; 229/185

[58] Field of Search ..... 229/117.01, 117.04, 229/117.16, 183, 185

[56] References Cited

U.S. PATENT DOCUMENTS

| | | | |
|---|---|---|---|
| 2,018,171 | 10/1935 | Himes . | |
| 3,195,798 | 7/1965 | Wilson | 229/183 |
| 3,322,323 | 5/1967 | Greene et al. . | |
| 3,366,496 | 1/1968 | Bomar et al. | 229/183 |
| 3,512,695 | 5/1970 | Anderson | 229/185 |
| 3,667,666 | 6/1972 | Pryor | 229/117.16 |
| 3,670,949 | 6/1972 | Galanes | 229/117.16 |
| 3,727,824 | 4/1973 | Giebel et al. | 229/117.16 |
| 4,187,976 | 2/1980 | Mather | 229/117.04 |
| 4,313,547 | 2/1982 | Osborne | 229/117.16 |
| 4,372,477 | 2/1983 | Wytko | 229/185 |
| 4,396,115 | 8/1983 | Watson . | |
| 4,842,189 | 6/1989 | Czosnyka | 229/117.16 |
| 5,316,210 | 5/1994 | Scullin | 229/185 |
| 5,499,764 | 3/1996 | Carlsson . | |

OTHER PUBLICATIONS

Abstract and Figures 1, 2 and 8 of U.S. application of Charles J. Mueller. This application is believed to have been recently filed by Mr. Mueller.

*Primary Examiner*—Gary E. Elkins
*Attorney, Agent, or Firm*—Pennie & Edmonds LLP

[57] ABSTRACT

A unitary carton blank is constructed with a panel orientation facilitating easy set up of an open ended carton from a collapsed carton structure. Of the panels of the carton blank, includes only one panel, namely the bottom panel, requires a single fold line.

11 Claims, 10 Drawing Sheets

CARTON CONSTRUCTION

BACKGROUND OF THE INVENTION

Carton blanks constructed of a series of connected foldable panels are available for consumer assembly of a carton. With prior art constructions, the carton blank is typically folded along fold lines separating the different panels of a blank and appropriately glued together to form a collapsed carton body. When it is desired to set up the folded carton body, the user manipulates the panels of the collapsed structure in the appropriate way so as to cause the collapsed structure to assume the shape of an open ended carton.

A typical box of the above described construction is disclosed in U.S. Pat. No. 2,018,171 to Himes. The Himes box construction is constructed to be set up from a collapsed form to an open ended box with a minimum of manipulation by the user. The box described in this patent is constructed from a blank made of heavy paper, cardboard, fiberboard and the like materials and requires that at least one of the end walls of the box be comprised of a triple thickness of blank material. With the Himes construction, the material required for forming the box is thus not at a minimum.

Also, the box construction disclosed in the Himes patent is not particularly suitable for stiff corrugated fiberboard, which generally cannot bend or fold except along preformed fold lines. This is so since setting up the Himes type box from the collapsed condition of the blank can require bending on some of the panels. Thus, the Himes construction is best suited for box constructions not employing stiff corrugated fiberboard.

Attempts have been made to improve upon the Himes box construction. One such construction is believed to have been developed by Charles J. Mueller. This construction, in appearance, is similar to that shown in the Himes patent, except that the single diagonal fold line in the bottom panel of the Himes box is replaced by double diagonal fold lines forming a "V" shape, with the open side of the "V" facing the adjacent side panel of the blank. These double fold lines permit the use of stiff corrugated material for forming a carton but tend to weaken the integrity and strength of the carton bottom. Since the panel of the box is the one which will take all of the weight of the contents of the box, this can be a disadvantage. The Mueller carton also requires the additional manufacturing steps of gluing a number of the blank panels together to produce the collapsed carton structure.

SUMMARY OF THE PRESENT INVENTION

In accordance with the present invention, the unitary carton blank is constructed with a panel orientation similar to that in the Himes and Mueller constructions. However, with the construction of the present invention, there is only one panel, namely the bottom panel, which requires a single fold line. Also, material is not wasted by requiring any more than a double thickness for one of the end walls and only this double layered end wall is preferably glued together.

With the present invention, the material for the carton blank is in fact reduced to a minimum, the manufacturing steps for producing the collapsed blank are at a minimum and the strength of the panels is kept at a maximum by minimizing the fold lines.

DETAILED DESCRIPTION OF THE INVENTION

Figure 1:
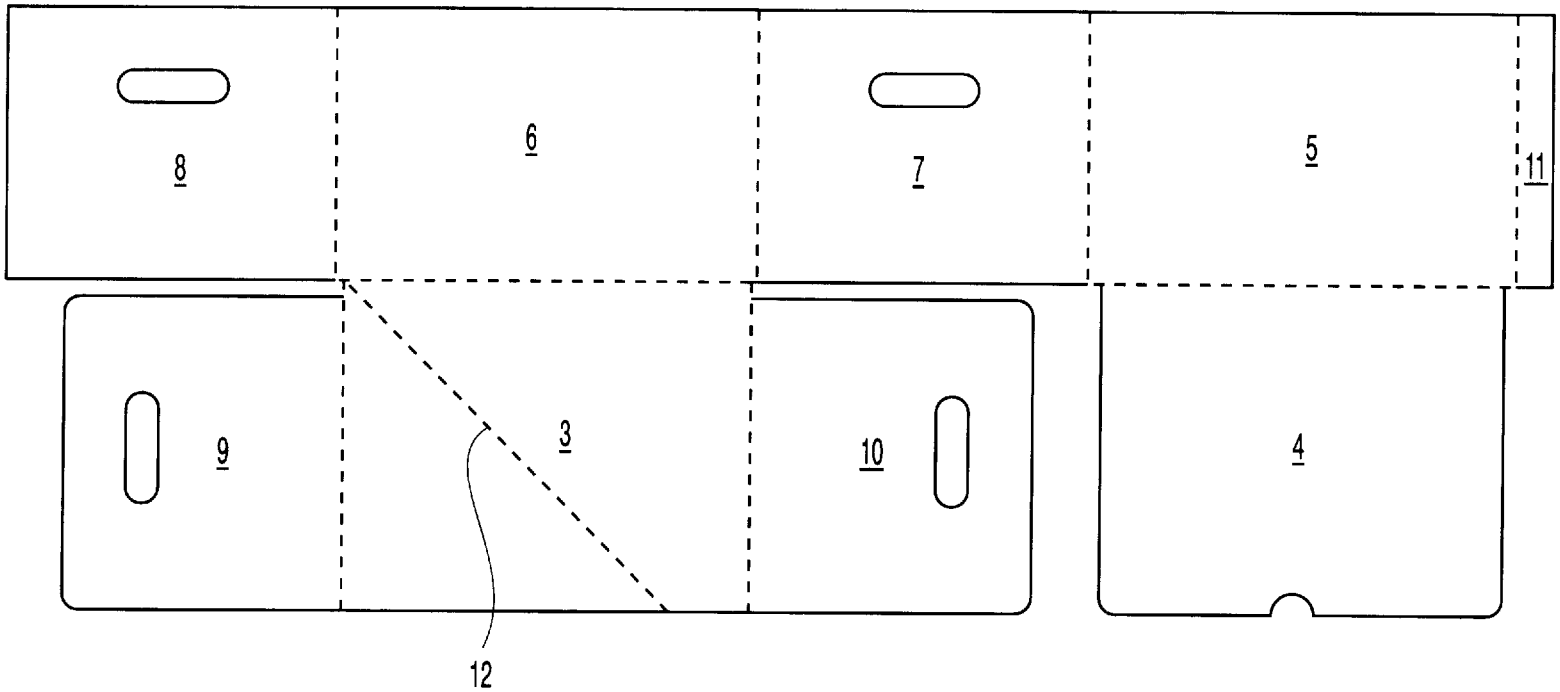
FIG. 1 is a plan view of the carton blank of the present invention.
Figure 10:
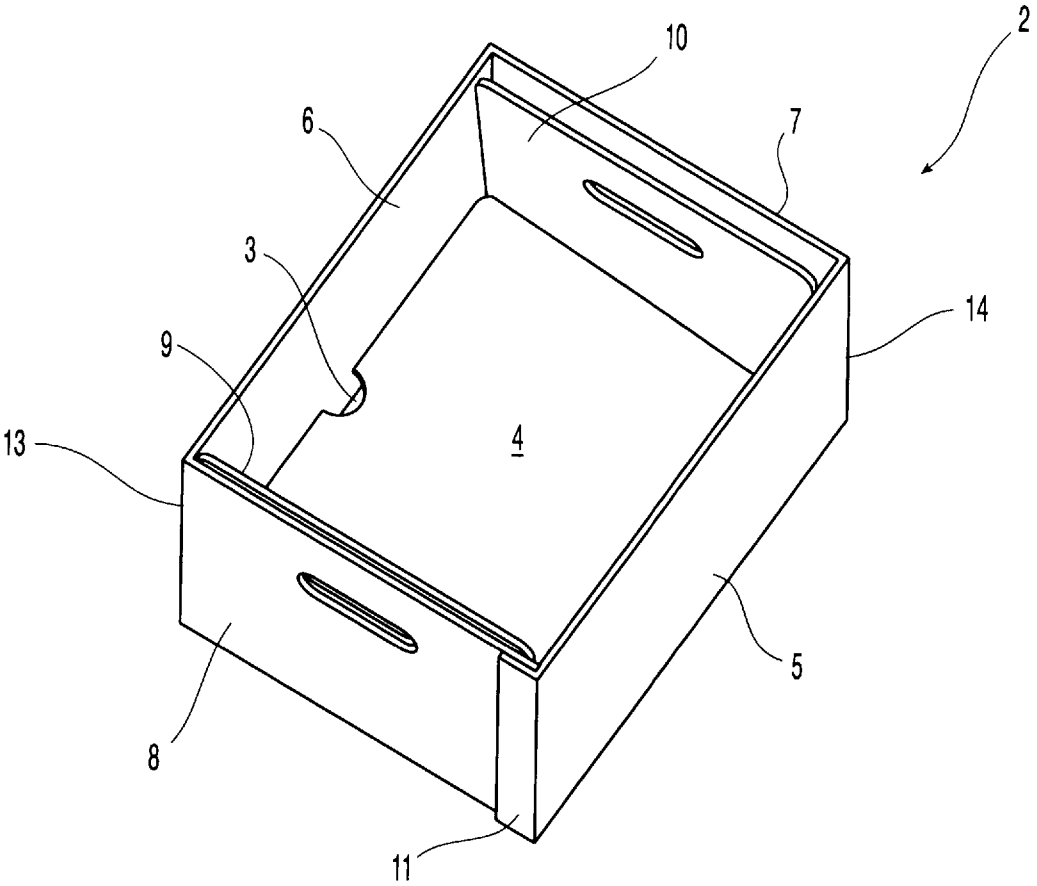
FIG. 10 is a perspective view of the completely set up open ended carton.

The carton blank of the present invention is constructed of stiff corrugated fiberboard. The blank 1, as shown in FIGS. 1 and 10, is comprised of a plurality of panel sections foldably connected together to define the open ended body of a carton 2. The body includes a bottom panel section defined by two bottom panels 3 and 4, a pair of side panel sections defined by two side panels 5 and 6, and a pair of end panel sections defined by four end panels 7, 8, 9 and 10. The side panel 5 also includes a flap panel 11.

In addition to the fold lines separating the various panels of the carton blank, the bottom panel 3 is provided with a diagonal fold line 12. This fold line extends from the bottom edge of the bottom panel 3 to the upper edge, at the location where the upper edge intersects the left side edge of the bottom panel. The angle of the diagonal fold line 12 is determined by the various dimensions of the individual panels and is dictated by the length of the side edges of the end panel 9. In particular, the spacing of the bottom of the diagonal fold line 12 from the left side edge of the bottom panel is equal to the length of the side edge of the end panel 9. This relationship is necessary for proper alignment of the panels in the collapsed carton, as more fully described below.

For purposes of description, each of the panels of the carton blank, as viewed in FIG. 1, includes a top edge, a bottom edge, a left side edge and a right side edge. With reference to FIG. 1, the side panel 5 has the right edge of the end panel 7 foldably connected to its left side edge. Also, the top edge of the bottom panel 4 is foldably connected to the bottom edge of the side panel 5. The end panel 7 has the right side edge of the other side panel 6 foldably connected to its left side edge. The other side panel 6 has its bottom edge foldably connected to the top edge of the bottom panel 3 and the right side edge of a second end panel 8 foldably connected to its left side edge. The bottom panel 3 has a third end panel 9 foldably connected to its left side edge and a fourth end panel 10 foldably to its right side edge. The top edge of each of these end panels 9 and 10 are separated from the bottom edge of the end panels 8 and 7, respectively.

In a preferred embodiment of the invention, the blank has an overall height of 22 3/16 inches, with the panel 5 having a height of 10 1/16 inches and the panel 4 a height of 12 1/8. Also, the panels have the following width dimensions:

| Panel | Width (in) |
|---|---|
| 5 | 15 7/16 |
| 6 | 15 3/8 |
| 7 | 12 3/16 |
| 8 | 12 |

The remaining panels have relative height and width dimensions in accordance with common practice.

FIGS. 2–8 show the progressive steps used in folding the panels of the blank of FIG. 1 into a collapsed carton. The order of the steps is not necessarily limited to that shown in FIGS. 2–8 but these steps are the preferred sequence.

Figure 2:
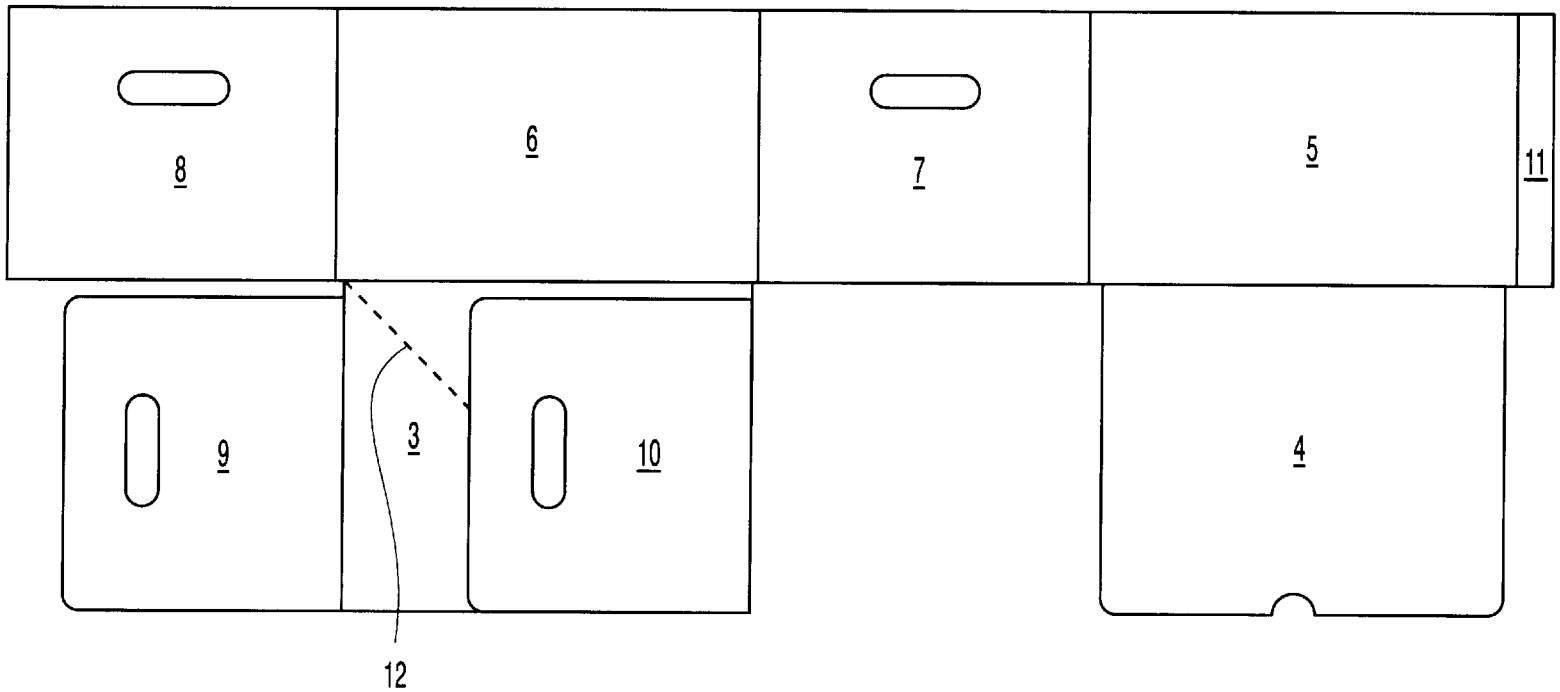
FIGS. 2–8 show the progressive preferred assembly steps used in forming the collapsed carton blank.
Figure 3:
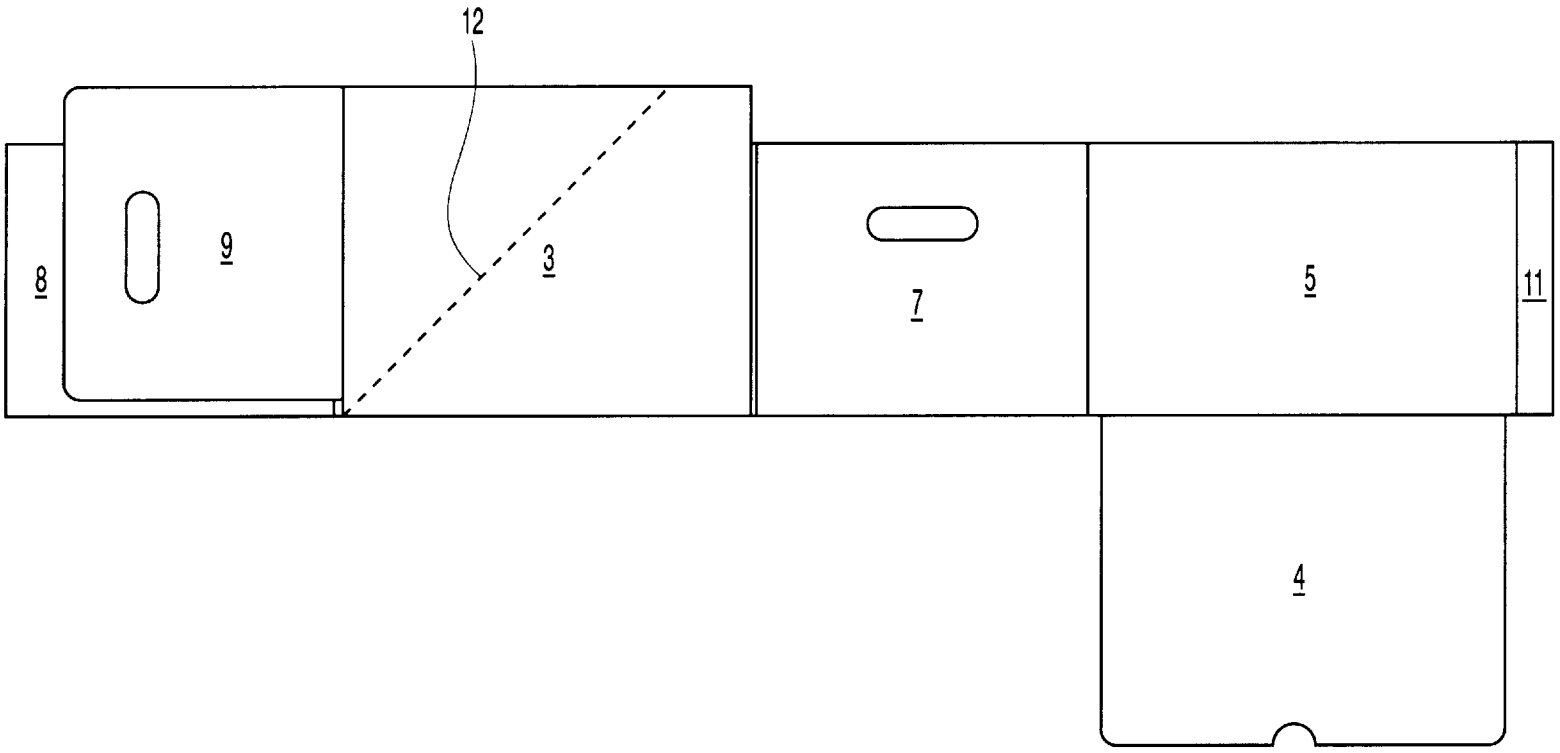
Figure 4:
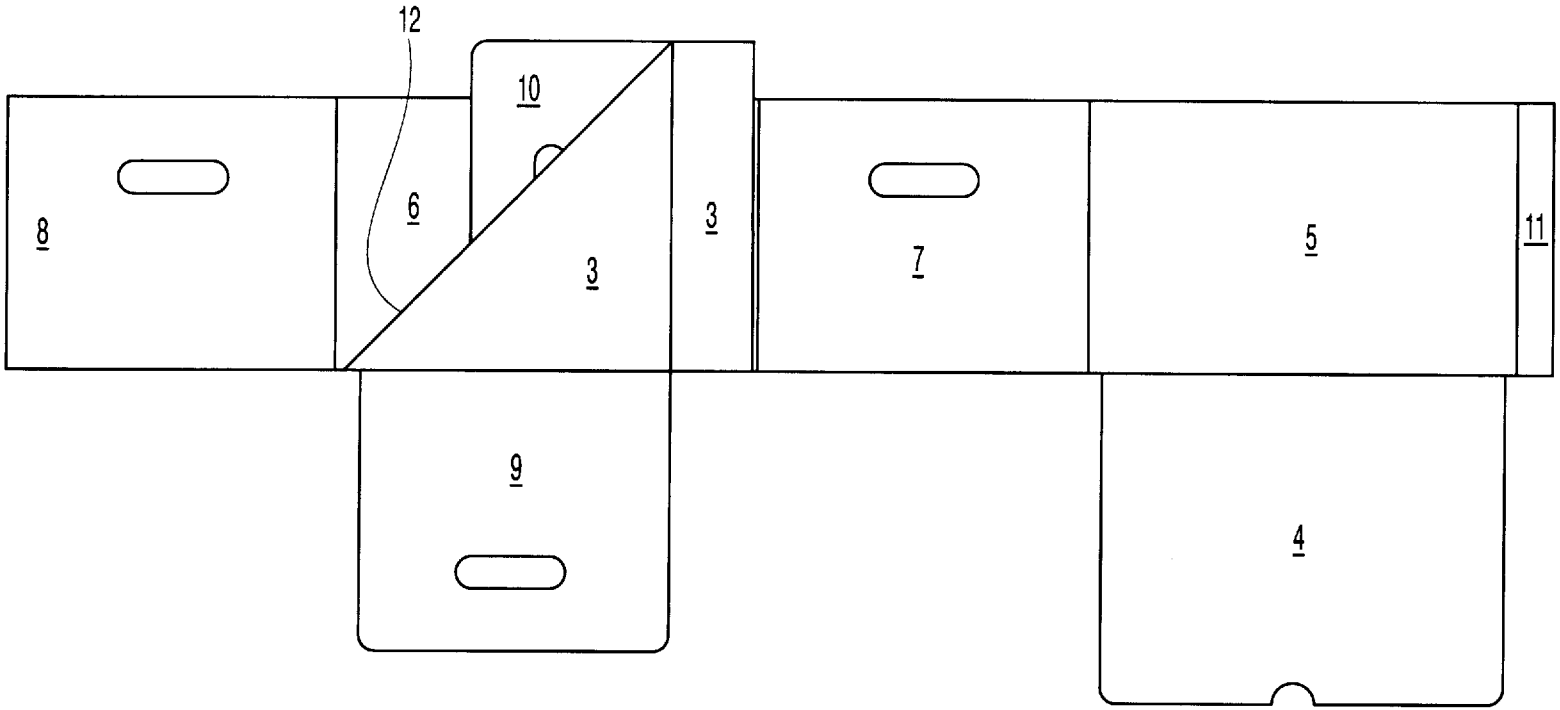
Figure 5:
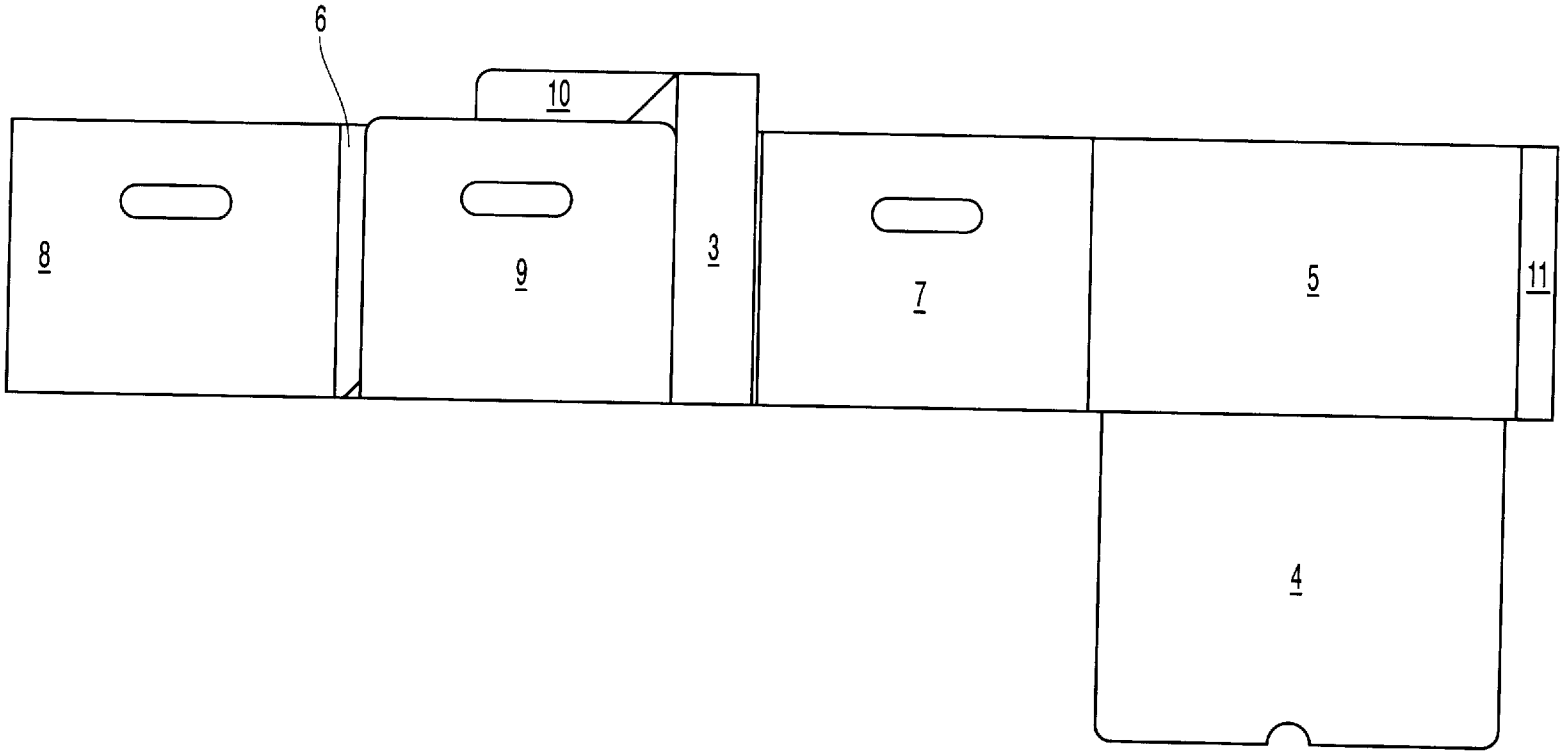
Figure 6:
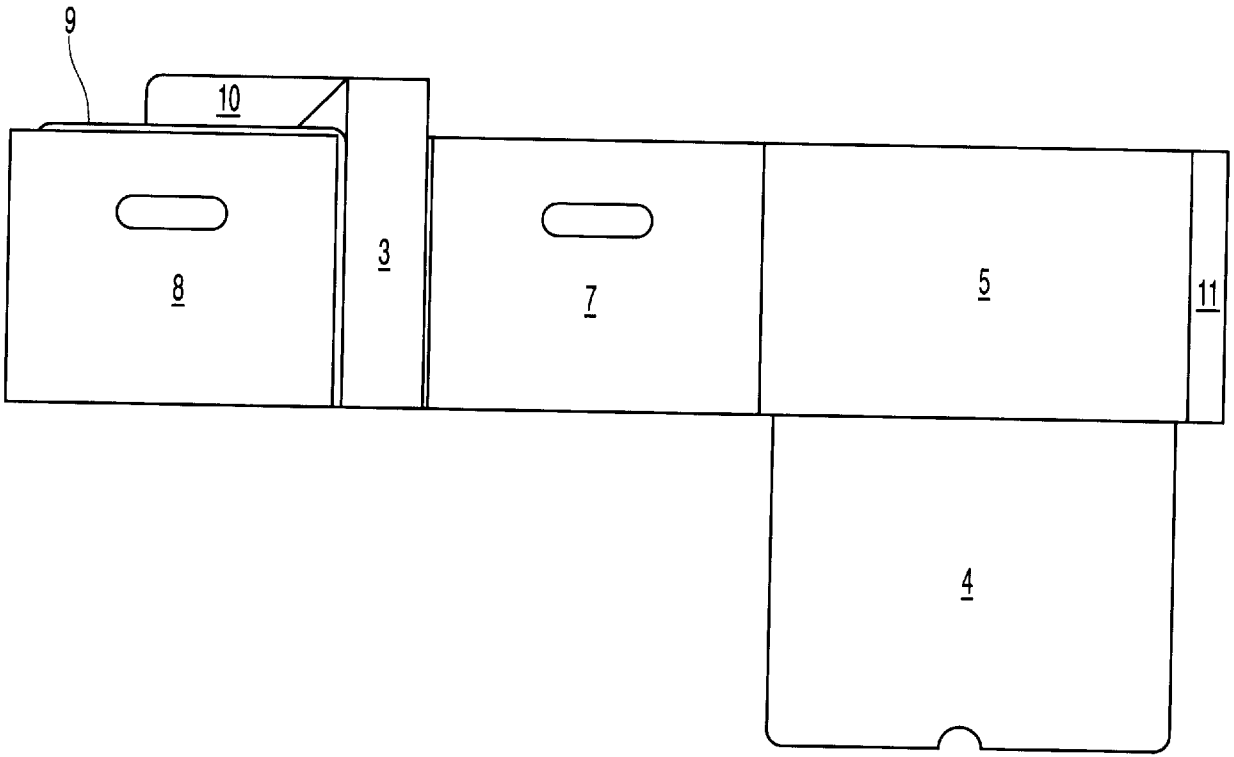
Figure 7:
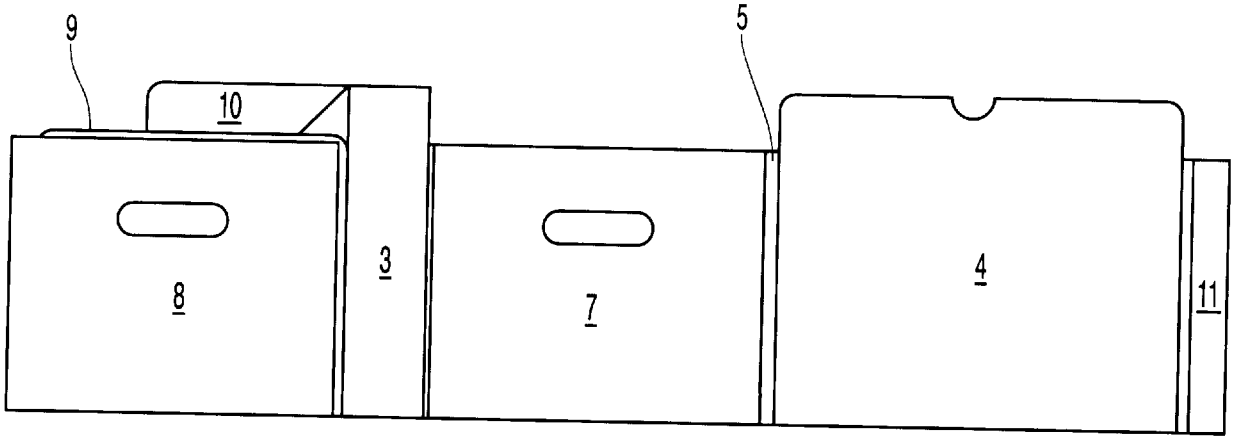

The first step, as shown in FIG. 2, is the folding of end panel 10, 180° along its left side edge into overlying relation with the bottom panel 3. In the description that follows, all of the remaining panels are folded in the same one direction except where otherwise noted with respect to the folding of the bottom panel along the diagonal fold line 12. The next step (FIG. 3) is the folding of the bottom panel 3, 180° along its top edge and over the side panel 6. The bottom panel is then folded 180°, in an opposite direction to the one direction, along the diagonal fold line 12 so as to align its left side edge with its top edge (FIG. 4). Next, the third end panel 9 is folded 180° along its left side edge to the position shown in FIG. 5. The second end panel 8 is next folded 180° over the third end panel and into face to face relationship therewith (FIG. 6). As noted above, the spacing of the bottom of the fold line 12 from the left side edge of the bottom panel is equal to the length of the side edge of the end panel 9. Accordingly, when the bottom panel 3 is folded along the diagonal fold line 12 and the end panel 9 is folded along its right side edge, the end panel 9 will be in the squared position shown in FIG. 5. Thus, when the end panel 8 is folded over, as shown in FIG. 6, it will be completely aligned with and superimposed on the folded end panel 9.

Figure 8:
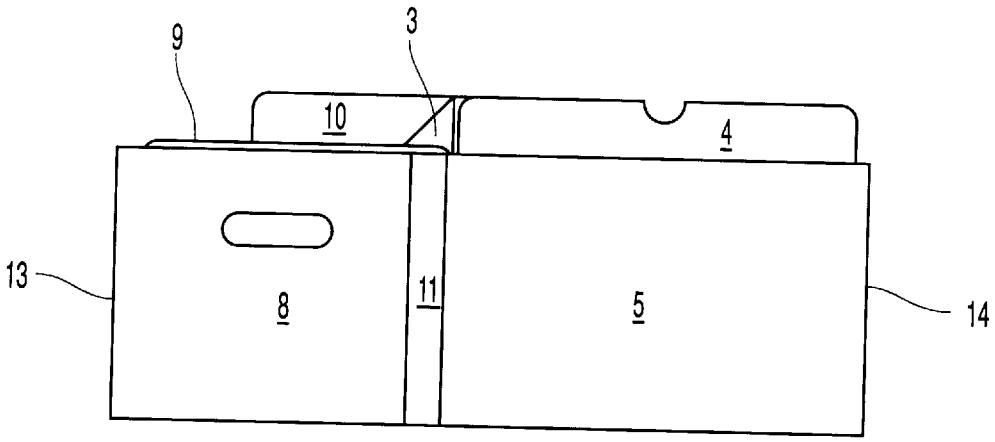

The collapsed carton body is completed by folding the bottom panel 4, 180° along its top edge and into overlying relation with the side panel 5 (FIG. 7), and the side panel 5 is folded along its left side edge 180° into a position in which the flap panel 11 overlies the left side edge of the end panel 8 (FIG. 8). Finally, the flap panel 11 is secured to the end panel 8, preferably by adhesive.

Although the flap panel 11 is shown as an extension of the side panel 5, it will be apparent that it could be formed as an extension of one of the end panels 8 and 9. The particular end panel 8 or 9 to which the flap panel is attached will depend on which of these end panels is to be the outside end panel. In the preferred embodiment, end panel 9 is the outside end panel.

With the above construction, the open ended carton has only one panel that is in any way weakened by a fold line, this being the bottom panel 3 with the single fold line 12. Also, there is no need to provide a triple wall thickness on any of the panels nor is the manufacturing procedure complicated by multiple gluing requirements. It is, of course, necessary to glue the flap 11 to the end panel 8. No other panels need be glued although in the preferred embodiment, the end panels 8 and 9 are glued together. This can be done because these panels do not require that they move relative to each other during the set up procedure.

Further, the gluing of the end panels 8 and 9 together can be effected in a single gluing operation combined with the gluing of the flap to these panels. This can be accomplished by folding the end panel 8 over the end panel 9 as the last step in the sequence of assembling the collapsed carton. In doing this, the flap panel 11 will be disposed between the end panels 8 and 9. With glue applied to both sides of the flap panel 11, it will become glued to both end panels and the end panels will therefore be glued to each other.

Figure 9:
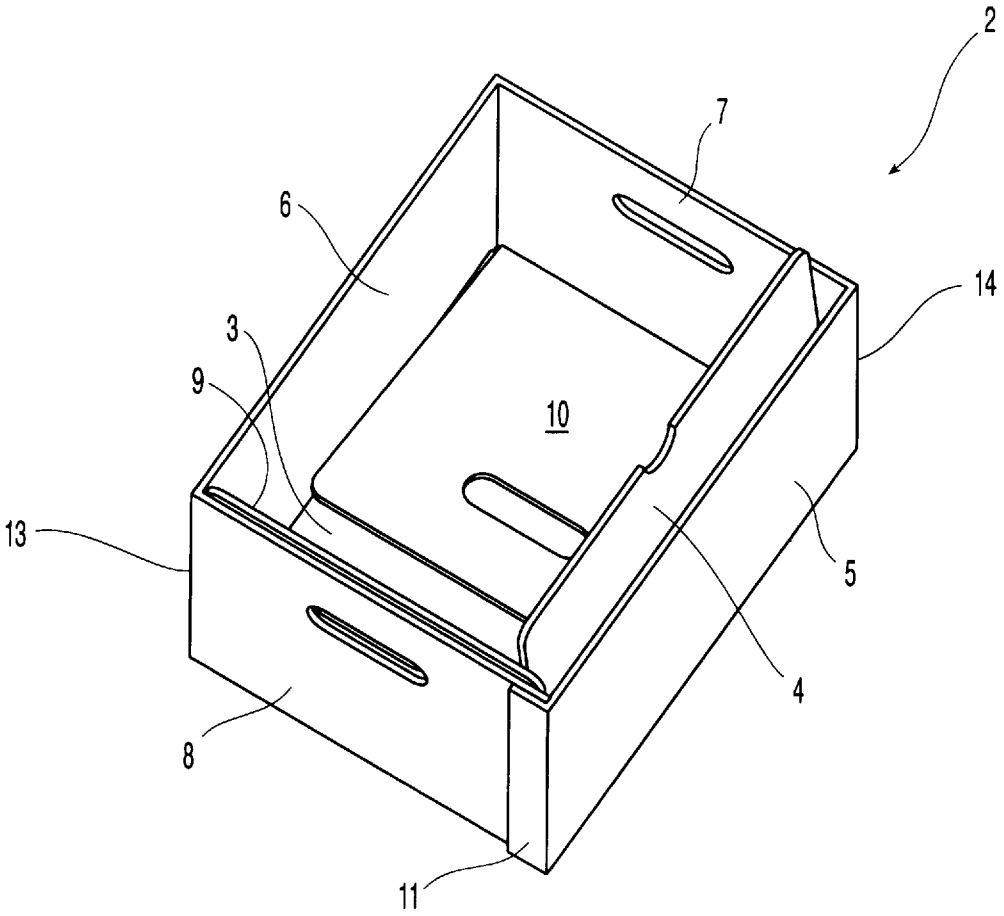
FIG. 9 is a perspective view of the partially set up open ended carton.

When it is desired to set up the open ended carton body, the user simply urges the two ends 13, 14 of the collapsed carton toward each other. Such a manipulation of the collapsed structure will produce the open ended carton 2 as shown in FIG. 9. To complete the set up, it is only necessary to raise the end panel 10 into face to face relation with the end panel 7 and to lower the second bottom panel 4 onto the bottom panel 3. This completed construction is shown in FIG. 10.

We claim:

1. A unitary carton blank comprising:

a) an open ended body including a plurality of panel sections foldably connected together for forming said body, said panel sections including:
   i) a bottom panel section,
   ii) a pair of side panel sections, and
   iii) a pair of end panel sections;

b) said bottom panel section includes at least one bottom panel;

c) each of said pair of side panel section includes a side panel;

d) each of said end panel sections includes no more than two end panels;

e) each of said panels includes a top edge, a bottom edge, a left side edge and a right side edge;

f) one of said side panels has the right side edge of one of said end panels foldably connected to the left side edge thereof;

g) said one end panel has the right side edge of the other of said side panels foldably connected to the left side edge thereof;

h) said other of said side panels has its bottom edge foldably connected to the top edge of said bottom panel and the right side edge of a second end panel foldably connected to the left side edge thereof;

i) said bottom panel has a third end panel foldably connected, to one side edge thereof;

j) said bottom panel includes a single diagonal fold line formed therein and extending diagonally from the bottom edge to the top edge thereof; and k) the remaining panels are free of any fold lines.

2. A unitary blank according to claim 1, wherein:

a) the blank is constructed to stiff corrugated fiberboard which will bend, during normal assembly into a carton, only along fold lines formed therein.

3. A unitary blank according to claim 2, wherein:

a) said diagonal fold line extends to the top edge of said bottom panel where it intersects said one side edge thereof.

4. A unitary blank according to claim 3, wherein:

a) the one side edge has a first length; and b) said diagonal fold line extends to the bottom edge of said bottom panel at a point spaced from said one side edge by a second length equal to said first length.

5. A unitary blank according to claim 4, wherein:

a) said diagonal fold line extends from the bottom edge of said bottom panel at a point spaced from the other side edge thereof.

6. A unitary carton blank according to claim 5, wherein:

a) the panel sections further include a flap panel foldably connected to one of said side panels and said end panel for gluing to the other of said side and end panel to form a folded collapsed carton body.

7. A unitary carton blank according to claim 6, wherein:

a) said bottom panel is folded 180°, in one direction, along its top edge over said other side panel;

b) said bottom panel is folded 180°, in an opposite direction to said one direction, along said diagonal fold line to align its left side edge with the top edge thereof;

c) said third end panel is folded 180°, in said one direction, along the right side edge thereof;

d) said second end panel is folded 180°, in said one direction, into face to face relation with said third end panel;

e) said one side panel is folded 180°, in said one direction, along its left side edge to bring said flap panel and one of said second and third end panels into overlying relationship; and f) said flap panel is adhesively attached to one of said second and third end panels in said overlying relationship.

8. A unitary carton blank according to claim 7, wherein:

a) said second and third end panels are adhesively attached to each other.

9. A unitary carton blank according to claim 8, wherein:

a) said flap panel is foldably connected to the right side edge of said one side panel and is adhesively attached to said second end panel, along the left side edge thereof.

10. A unitary carton blank according to claim 9, wherein:

a) said bottom panel has a fourth end panel foldably connected to the right side edge thereof; and b) said fourth end panel is folded 180°, in said one direction, into position between said other side panel and said bottom panel.

11. A unitary carton blank according to claim 10, wherein:

a) said bottom panel section includes a second bottom panel foldably connected to the bottom edge of said one side panel, said second bottom panel being folded 180°, in said one direction, along its top edge into overlying relation with said one side panel.

* * * * *